US010422144B2

(12) United States Patent
Pelot et al.

(10) Patent No.: US 10,422,144 B2
(45) Date of Patent: Sep. 24, 2019

(54) JOINT TAPE EMBEDDING APPARATUS, SYSTEM, AND METHOD

(71) Applicant: UNITED STATES GYPSUM COMPANY, Chicago, IL (US)

(72) Inventors: David D. Pelot, Chicago, IL (US); William J. Rago, Gurnee, IL (US); Charles W. Cochran, Elkhorn, WI (US); Samar Emami, Chicago, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 86 days.

(21) Appl. No.: 15/722,359

(22) Filed: Oct. 2, 2017

(65) Prior Publication Data

US 2019/0100927 A1 Apr. 4, 2019

(51) Int. Cl.

| | |
|---|---|
| ***E04F 21/02*** | (2006.01) |
| ***E04F 21/165*** | (2006.01) |
| ***B44C 7/04*** | (2006.01) |
| ***E04F 21/05*** | (2006.01) |
| *B65H 35/00* | (2006.01) |
| *B44C 7/06* | (2006.01) |

(52) U.S. Cl.

CPC ..... *E04F 21/026* (2013.01); *B44C 7/04* (2013.01); *E04F 21/05* (2013.01); *E04F 21/165* (2013.01); *E04F 21/1652* (2013.01); *E04F 21/1657* (2013.01); *B44C 7/06* (2013.01); *B65H 35/0053* (2013.01); *Y10T 156/1788* (2015.01)

(58) Field of Classification Search

CPC ..... B44C 7/04; E04F 21/026; E04F 21/1652; E04F 21/1657; B65H 35/0053; Y10T 156/1788; Y10T 156/1795

See application file for complete search history.

(56) References Cited

U.S. PATENT DOCUMENTS

| | | | | |
|---|---|---|---|---|
| 3,960,643 A | | 6/1976 | Dargitz et al. | |
| 4,224,854 A | * | 9/1980 | Malacheski | B23Q 9/0014 83/455 |
| 5,049,058 A | * | 9/1991 | Ives | B29C 37/0064 156/574 |
| 5,063,800 A | * | 11/1991 | Jung | A41H 15/00 269/21 |
| 5,279,700 A | | 1/1994 | Retti | |

(Continued)

FOREIGN PATENT DOCUMENTS

| | | |
|---|---|---|
| JP | H0336363 A | 2/1991 |
| JP | 2002121889 A | 4/2002 |

OTHER PUBLICATIONS

How To Apply a Knockdown Drywall Texture, Aggregate Solutions, URL: <http://www.drywallinfo.com/knockdown-texture.html>, Retrieved from the Internet May 25, 2017.

(Continued)

*Primary Examiner* — Mark A Osele

(74) *Attorney, Agent, or Firm* — Vorys, Sater Seymour and Pease LLP; Pradip Sahu; Philip T. Petti

(57) ABSTRACT

A joint tape embedding apparatus configured to determine the bonding and/or "feel" of embedding joint tape into a dry wall or wall board joint using a particular joint compound. The joint embedding apparatus is configured to allow the same user or different users to accurately repeat the determination of the bonding and/or "feel" attributes of the joint compound.

20 Claims, 7 Drawing Sheets

(56) References Cited

U.S. PATENT DOCUMENTS 5,537,226 A * 7/1996 Wolberg ..... H04N 1/0473 358/486
5,605,251 A * 2/1997 Retti ..... B05C 5/02 222/1
5,964,686 A * 10/1999 Bidlack ..... B26D 1/185 493/160
6,565,252 B2 5/2003 Dillinger et al.
6,644,702 B2 * 11/2003 Liou ..... B25G 3/26 16/422
7,216,432 B2 * 5/2007 Poteet ..... B25G 1/102 16/422
7,401,657 B2 * 7/2008 Huber ..... A01B 31/00 172/395
8,231,371 B1 7/2012 Jalbert
8,245,615 B2 * 8/2012 Brazier ..... B26D 1/18 83/171
8,245,753 B2 * 8/2012 Haemerle ..... B26B 5/00 156/579
8,747,006 B2 6/2014 Payne
10,275,722 B2 * 4/2019 White ..... G01B 11/002
2003/0029542 A1 2/2003 Dillinger
2005/0098290 A1 * 5/2005 Komposch ..... D21F 3/06 162/198
2009/0094936 A1 4/2009 Brown
2014/0163905 A1 6/2014 Vaynberg et al.
2017/0241881 A1 * 8/2017 Pelot ..... G01N 3/56
2018/0283019 A1 * 10/2018 Telleria ..... B05C 5/02

OTHER PUBLICATIONS

How To Skip Trowel Texture (with Pictures)—wikiHow, URL: <http://www.wikihow.com/Skip-Trowel-Texture>, Retrieved from the Internet May 25, 2017.

Search Report and Written Opinion dated Feb. 21, 2019 for PCT/US2018/053004 to United States GYPSUM Company filed Sep. 27, 2018.

* cited by examiner

JOINT TAPE EMBEDDING APPARATUS, SYSTEM, AND METHOD

FIELD

The present invention is directed to a joint tape embedding apparatus, system, and method configured for embedding joint tape into a drywall or wall board joint using a particular joint compound, in particular for controlled joint tape embedding of joint tape. The present invention, can include determining the bonding or adhesive characteristics of the joint compound and joint tape, and determining and characterizing the attributes and "feel" of the joint compound.

BACKGROUND

A joint located between adjacent sheets of drywall or wall board consists of tape embedded within joint compound. The embedding process has many factors, which can influence the adhesive strength, measured by ASTM C474, between the joint compound and the tape. The influencing factors include knife angle, knife pressure, amount of compound on the knife before, during, and after embedding the tape, all of which have different amounts of influence.

The measurement of bond strength relies on the joint compound's ability to bond, the tape's ability to bond, and the embedding practice used. When a person is trying to identify the bonding ability of only the joint tape or only the joint compound by conducting a bond test (ASTM C474 or otherwise), it is impossible to determine how much of the result was influenced by the other two factors. By using a controlled tape embedding apparatus, the embedding practice used is consistent across all tests regardless of the operator or other personal factors. Therefore, the embedding practice influence is fixed and the ability of only the joint tape to bond or only the joint compound to bond can be determined.

Thus, there exists a need for an apparatus, system, and method, which controls these factors, or the mechanics, of embedding joint tape into joint compound to provide consistent and accurate results.

Further, while spreading wet building material such as joint compound spackle, etc., applicators feel the material and prefer a specific feel of the product. This feel is the result of how the material flows due to the application forces while being spread, typically by some type of application device (e.g. knife). There exists a need to measure forces on the application device during the spreading operation. Specifically, it is desired to measure one or more components of forces involved with spreading the building material (e.g. joint compound) at specific parameters.

Thus, there exists a need for an apparatus, system, and method for accessing or determining the forces on the application device to analyze and characterize the "feel" of the joint compound in a standardized and meaningful manner, which information can be used by the manufacturer of joint compound and users (e.g. applicators) purchasing and applying joint compounds.

SUMMARY

The presently described subject matter is directed to determining the ability of joint tape to bond.

The presently described subject matter is directed to determining the ability of joint compound to bond.

The presently described subject matter is directed to determining the ability of joint tape and joint compound to bond to each other and/or bond to drywall or wall board.

The presently described subject matter is directed to an apparatus, system, and method of determining the ability of joint tape to bond and/or the ability of joint compound to bond to each other and/or to bond to drywall or wall board.

The presently described subject matter is directed to an apparatus, system, and method of quantifying the hand application properties of joint compound.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with one or more weights.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with one or more weights, and wherein the one or more weights on the knife can be changed.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the pivoting arm is provided with one or more weights.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the pivoting arm is provided with one or more weights, and wherein the one or more weights on the pivoting arm can be changed.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with one or more weights, and wherein the pivoting arm is provided with one or more weights.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with a reinforcement bar configured to reinforce an edge of the knife.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with one or more weights, and wherein the pivoting arm is provided with one or more weights, and wherein the knife is provided with a reinforcement bar configured to reinforce an edge of the knife.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the knife is provided with one or more weights, and wherein the pivoting arm is provided with one or more weights, wherein an upper end of the pivoting arm is pivotably connected to the slidable carriage and a lower end of the pivoting arm is fixed to the knife.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, further comprising a joint compound applicator for delivering joint compound to the knife during operation.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, further comprising a joint compound applicator for delivering joint compound to the knife during operation, wherein the joint applicator comprises a joint compound pump having tubing connected to a nozzle located to supply joint compound to the knife.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, wherein the spaced apart rails are connected to cross-members of the frame located at ends of the frame.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, further comprising an actuator configured to move the slidable carriage.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, further comprising an actuator configured to move the slidable carriage, further comprising one or more sensors configured to measure force on the knife during operation.

The presently described subject matter is directed to a joint tape embedding apparatus configured for controlled embedding of the joint tape into joint compound, the apparatus comprising or consisting of a frame; a pair of spaced apart rails supported by the frame; a carriage slidably supported by said rails; a swing arm pivotably connected to the carriage; and a knife connected to the to the swing arm, further comprising an actuator configured to move the slidable carriage, further comprising one or more sensors for detecting the location and speed of movement of the slidable carriage during operation.

The presently described subject matter is directed to a joint tape embedding system configured for controlled embedding of joint tape into a drywall joint using a particular joint compound, the apparatus comprising or consisting of a frame; a pair of spaced apart rails supported by the frame; a carriage slidably supported by said rails; a swing arm pivotably connected to the carriage; a knife connected to the to the swing arm; one or more electrical sensors to measure physical characteristics of spreading or application of the joint compound into a joint; and a computer for receiving input signals from the one or more electrical sensors and configured to provide quantitative assessment of the feel attributes of the joint compound.

The presently described subject matter is directed to a method for controlled embedding of joint tape into a drywall joint using a particular joint compound, the method comprising or consisting of providing a measuring device comprising a knife applicator; providing a supply of joint compound to be measured to the knife applicator; using the knife applicator apply joint compound to embed the joint tape into a drywall or wall board joint; measuring one or more physical characteristics involved with the spreading or application of the joint compound using the knife applicator; quantitatively assessing the particular joint compound using the measured physical characteristics; and determining the feel of the particular joint compound expressed in a manner understandable to users of joint compounds.

The first aspect of the invention relates to a tape embedding device that can be used as an engineering control for ensuring repeatable and reproducible results. This device provides for controlled tape embedding in joint compound. This device also obtains properties of a joint formed by tape embedded within joint compound. The tape embedding process has many factors that can influence the adhesive strength, measured by ASTM C474, between joint compound and tape. The influencing factors include knife angle, knife pressure, amount of compound on the knife before, during, and after embedding the tape; all of which have different amounts of influence.

Measurement of bond strength relies on the joint compound's ability to bond, the tape's ability to bond, and the embedding practice used. When a person is trying to identify the bonding ability of only the tape or only the compound by conducting a bond test (ASTM C474 or otherwise), it is impossible to determine how much of the result was influenced by the other two factors. The present invention includes an apparatus which controls these factors, or the mechanics, of embedding tape to achieve repeatable and reproducible results. By using a controlled embedding apparatus, the embedding practice used is consistent across all tests regardless of the operator or other personal factors. Therefore, the embedding practice influenced is fixed and the ability of only the tape to bond or only the compound to bond can be determined. This controlled embedding apparatus includes a supporting structure (support frame), knife applicator, and material dispenser (building material applicator). The knife applicator will move at specified angle and speed and will have sensors to measure force, drag, and knife deflection during the application process. The operating parameters and measurements are processed by a computer to result in a quantitative assessment of the material.

In addition to providing a device for controlled measurement of bond strength of joint compound of a joint or measurement of properties of the joint itself, a second aspect of the invention relates to measuring or determining or characterizing the feel of building materials during their application. While spreading wet building materials such as joint compound, textures, spackle, etc., customers applying the product material feel the product material and prefer a specific feel of the product material. This feel is the result of how the material flows due to application forces while being spread, typically by some type of application knife. These forces can be measured by a device of the invention that measures multiple components of the forces involved in spreading wet building material at specific parameters. Thus, instead of tape embedding, the present invention can use the above-described controlled tape embedding apparatus for measuring the feel of building materials during their application. Thus, the device can be used to quantify properties of a product which customers prefer. As described above, this device includes a supporting structure (support frame), knife applicator, and material dispenser (building material applicator). The knife applicator will move at specified angle and speed and will have sensors to measure force, drag, and knife deflection during the application process. The operating parameters and measurements are processed by a computer to result in a quantitative assessment of the material.

A first purpose of this invention is to accurately and reproducibly measure the amount of adhesion between joint tape and joint compound. The amount of adhesion between joint tape and joint compound is dependent on the bonding ability of the tape, joint compound, and the application or embedding process. When designing joint compound or joint tape it is important to measure its bonding capability. To accurately, repeatedly, and reproducibly measure the bonding ability between a joint tape and a joint compound it is necessary to remove the influence of the embedding process as a contributing factor to the result of the test. The device of the present invention removes the influence of the embedding process as a contributing factor when testing the adhesive strength between joint tape and joint compound. Thus, in order to control the embedding practice of an individual, the invention is directed to an apparatus which is fixed in its knife angle, downward pressure, and the knife's ability to flex. The apparatus provides an engineering control to enable multiple users to get the same result when using the same compound and tape. To facilitate the purpose of tape embedding, preferably the device has a swing arm able to lift and swing back to a certain amount and then stop (this is useful for cleaning the bottom of the knife), and has a handle attached to the top of weights of the device.

Another purpose of this invention is more generally to use the device to quantify the hand application properties of joint compound, texture products, spackle, or any other knife applied wet building material. Building materials, such as joint compound, texture products, and spackle, are preferred by customers for various reasons. Application styles and techniques vary from one customer to another and each customer looks for certain physical attributes when hand applying products using a knife, trowel, skip trowel, and knock-down methods, etc. Customers have always communicated their needs and preferences by associating physical application "feel" to the products or describing physical attributes of the products using common jobsite terminology (non-technical) to the products. These physical attributes can be described using terms such as "loose", "long flow", "bodied", "slick", "gloppy", "high drag", "gritty", etc. It is often challenging to scientifically depict, understand and quantify these physical attributes. To develop products that could meet certain requirements and attributes of interest, the present invention measures the product in the device of the invention and the measured results relate to the "feel" described by the customers. This invention provides an effective/reproducible/repeatable means of uniformly applying the building materials and quantifying/measuring the overall force/work as a result of existing external forces, friction, shear, etc.

Although the device is described above (and below) as including a knife for applying the joint compound, the device could apply the material with a knife, trowel, or other commonly used implement to apply/spread the relevant building material. The device of the present invention can also be operated to reproduce the motions of common building material application techniques such as skip troweling.

Apparatus or Device

The invention device or apparatus itself includes a support frame, a sliding rail, a swing arm, and a weighted knife.

In particular, the apparatus or device for measuring the feel of building materials during application or accurately and reproducibly measuring the amount of adhesion between joint tape and joint compound includes the following parts:

1) a support frame;
2) a sliding rail;
3) a swing arm; and
4) a knife applicator installed on the swing arm, the knife applicator being weighted, the knife applicator being slidably supported by the support frame.

The sliding rails ensures the user has a straight pull down stroke, holds the knife's butt end at a constant, but adjustable, height so the angle of the knife is fixed, and prevents any roll or yaw of the knife from occurring, and is the handle used to pull the weighted knife so the user has no influence on the knife embedding.

The swing arm allows the knife to lay flat on the surface even if height is adjusted and allows the knife to respond to any large perturbations in the surface, and enables the user to flip the knife back to rest on the L channel so the underside of the knife blade can be easily cleaned.

The weighted knife ensures a constant embedding force in two areas of the knife, and has an eye bolt for easy gripping of the weighted knife.

System

The invention provides a system for measuring the feel of building materials during their application as well as being useable for controlled tape embedding in joint compound including the following:

1) a support frame;
2) a knife (or other common tool) applicator slidably supported by the support frame;
3) a building material applicator configured to supply building material to the knife applicator;
4) one or more electrical sensors to measure physical characteristics of spreading or application of the building material onto a surface; and
5) a computer and/or central processing unit (CPU) for receiving input signals from the one or more electrical sensors and configured to provide quantitative assessment of feel attributes of the test material.

Detailed Features 1) sensors measure force, drag, and knife deflection of knife applicator during spreading or application of building material.

Method for Controlled Tape Embedding in Joint Compound

In the first aspect, the method of the invention provides controlled tape embedding in joint compound to facilitate measuring the amount of adhesion between the joint tape and the joint compound.

Steps 1) providing the above-described measuring device comprising a knife (or other tool) applicator;
2) providing a supply of building material, namely joint compound, to be supplied to the knife applicator;
3) using the knife applicator to apply joint compound to a surface, then apply the tape, and then apply more joint compound (however, the last application of joint compound is optional);
4) measuring one or more physical characteristics involved with the spreading or application of the building material using the knife applicator; and
5) quantitatively assessing the building material using the measured physical characteristics.

Detailed Features 1) the knife (or other tool) applicator is fitted with one or more electrical sensors to measure the one or more component forces;
2) electrical output signals of the one or more electrical sensors are received and processed by central processing unit of a computer configured to provide quantitative assessment of feel attributes of the test material;
3) the measuring device comprises a support frame for slidably supporting the knife applicator;
4) the measuring device comprises a dispenser (building material applicator) for applying the test building material to the knife applicator; and
5) force, drag, and knife deflection of the knife applicator are measured during application of the building material.

The invention has been used to quantitatively measure the bonding performance of paper tape. This measure helps formulators interpret their tape bond result when testing new formulations of the joint compound. Every time a formulator wants to measure the bonding performance of their current tape, he or she would conduct a standardized test and input the results into an Excel sheet. This device was also used to measure the bonding performance of different joint compounds.

Method for Measuring the Feel of Building Materials

In the second aspect, the method of the invention for measuring the feel of building materials during their application or measures the amount of adhesion between joint tape and joint compound.

Steps 1) providing the above-described measuring device comprising a knife (or other tool) applicator;
2) providing a supply of building material to be supplied to the knife applicator;
3) spreading the building material onto a surface using the knife applicator;
4) measuring one or more physical characteristics involved with the spreading or application of the building material using the knife applicator; and
5) quantitatively assessing the building material using the measured physical characteristics Detailed Features 1) the knife (or other tool) applicator is fitted with one or more electrical sensors to measure the one or more component forces;
2) electrical output signals of the one or more electrical sensors are received and processed by computer configured to provide quantitative assessment of feel attributes of the test material;
3) the measuring device comprises a support frame for slidably supporting the knife applicator;
4) the measuring device comprises a dispenser (building material applicator) for applying the test building material to the knife applicator; and
5) force, drag, and knife deflection of the knife applicator are measured during application of the building material.

DETAILED DESCRIPTION

Figure 1:
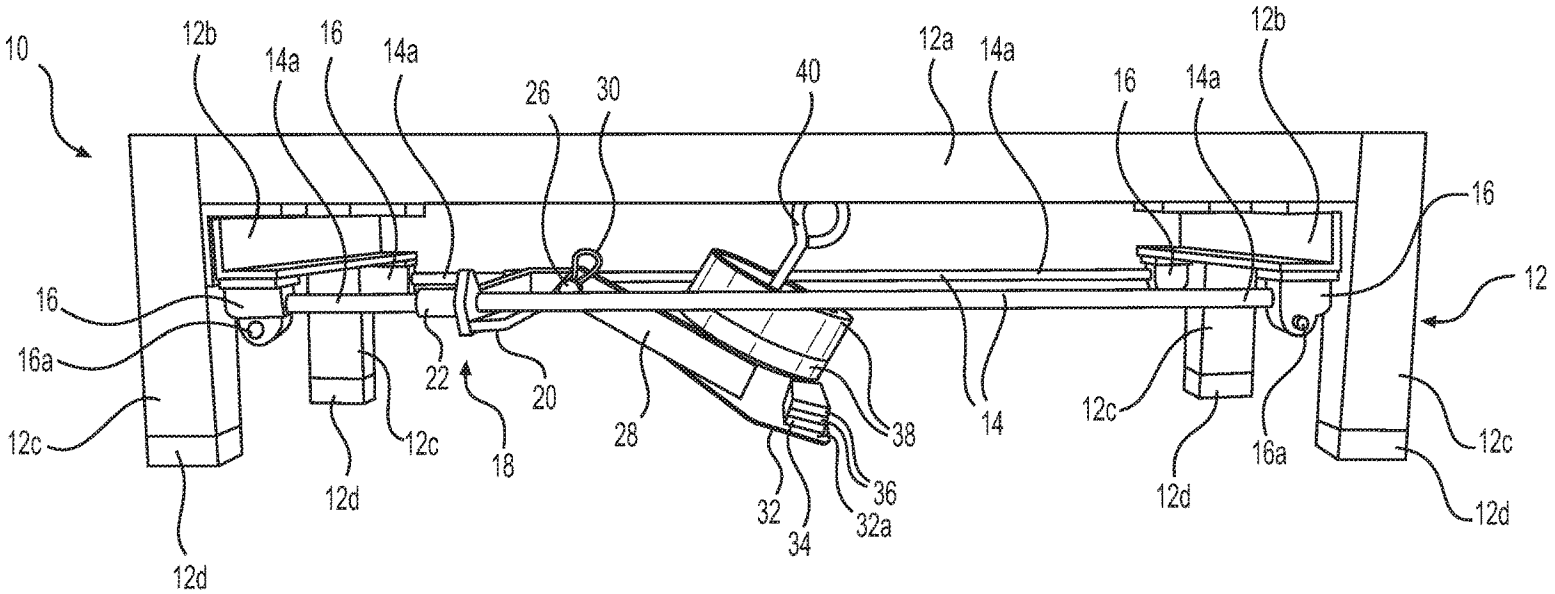
FIG. 1 is a front elevational view of a joint tape embedding apparatus according to the present invention.
Figure 2:
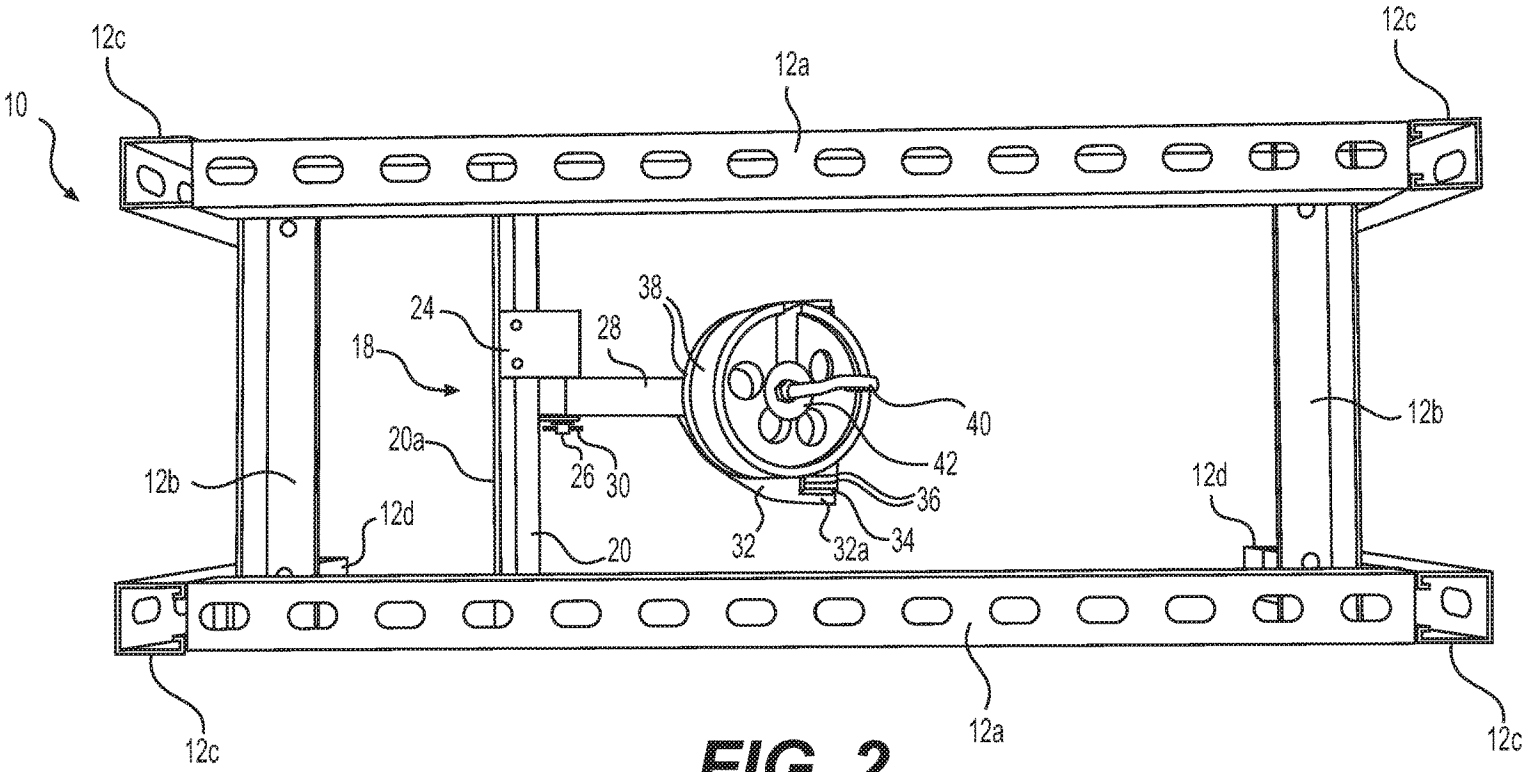
FIG. 2 is a top planar view of the joint tape embedding apparatus shown in FIG.
Figure 3:
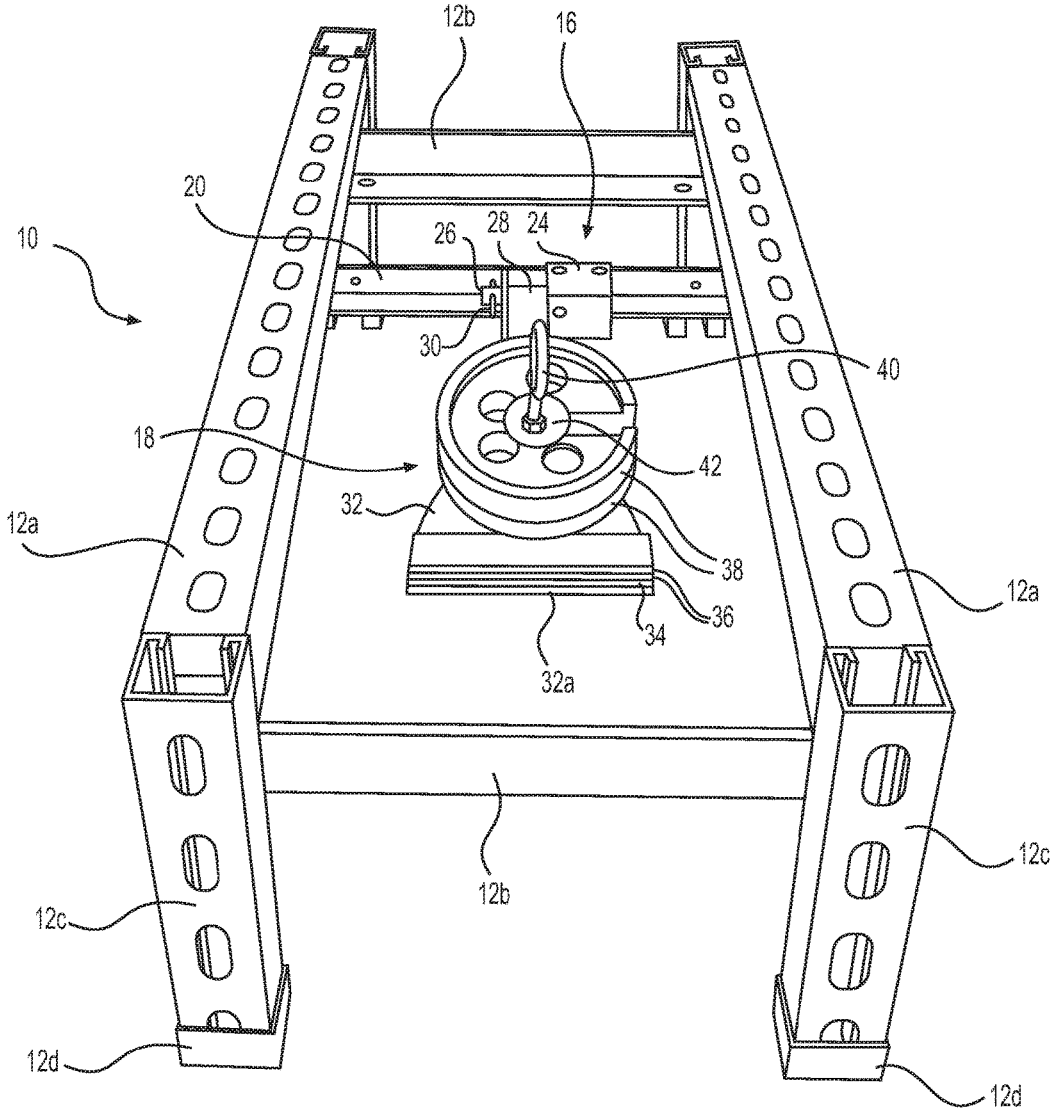
FIG. 3 is an end elevational view of the joint tape embedding apparatus shown in FIG. 1.
Figure 4:
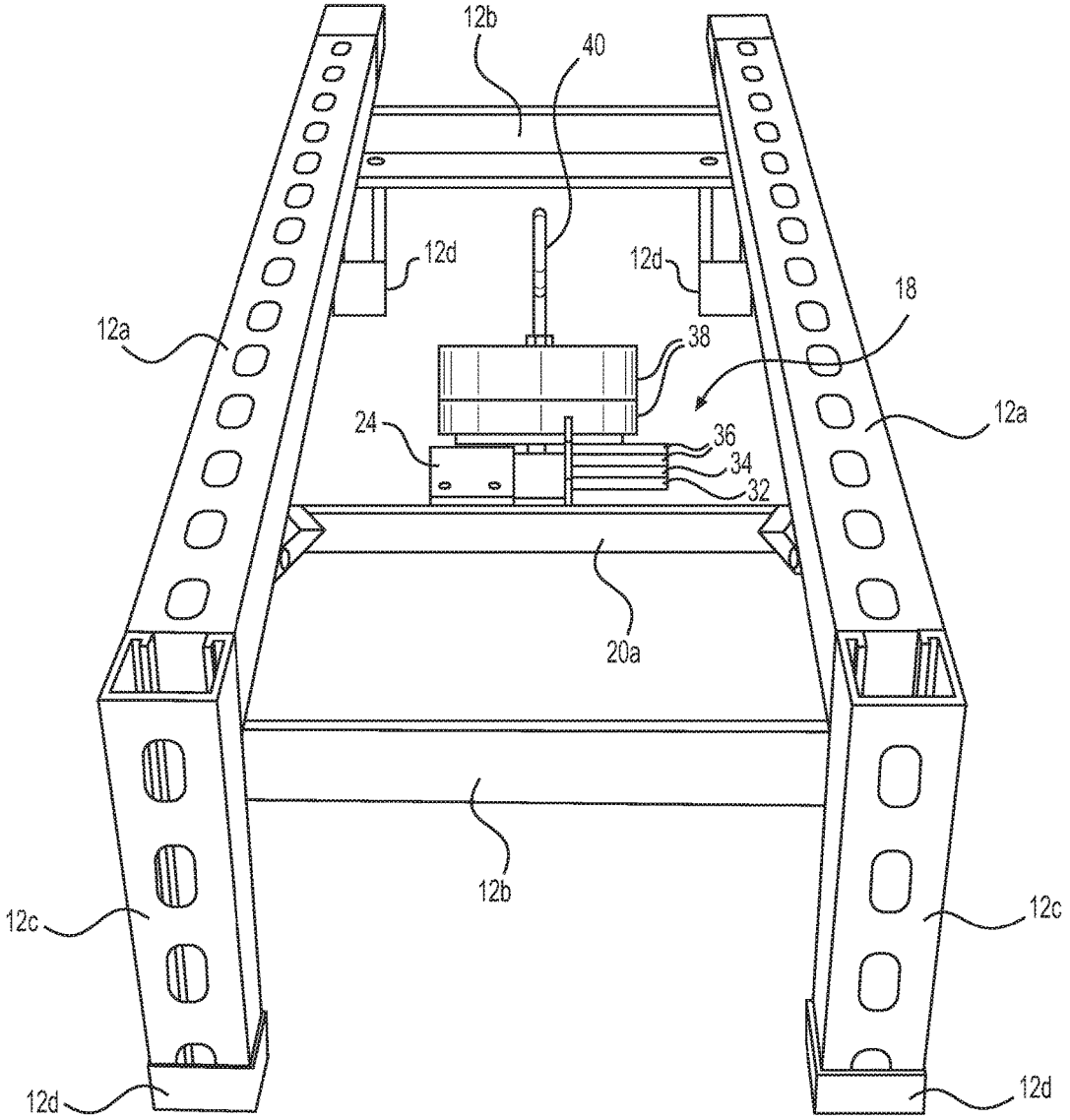
FIG. 4 is an opposite end elevational view of the joint tape embedding apparatus shown in FIG. 1.

A joint tape embedding apparatus 10 according to the present invention is shown in FIGS. 1-4.

The joint tape embedding apparatus 10 comprises a frame 12 having horizontal side members 12*a*, horizontal cross-members 12*b*, and vertical legs 12*c* connected together into the frame 12. For example, the frame 12 is made of tubing sections (e.g. rectangular steel tubing sections) welded and/or fastened together to assemble the frame 12. A set of resilient pads 12*d* are applied to the bottom ends of the vertical legs 12*c* to maintain the frame 12 stationary during use.

A pair of spaced apart guide rails 14 (e.g. made of solid or tubular round bar stock) is supported by the frame 12. Specifically, the opposite ends 14*a* of each guide rail 14 is connected to the cross-members 12*b* of the frame 12 by connectors 16 having threaded fasteners 16*a* (FIG. 1).

Figure 5:
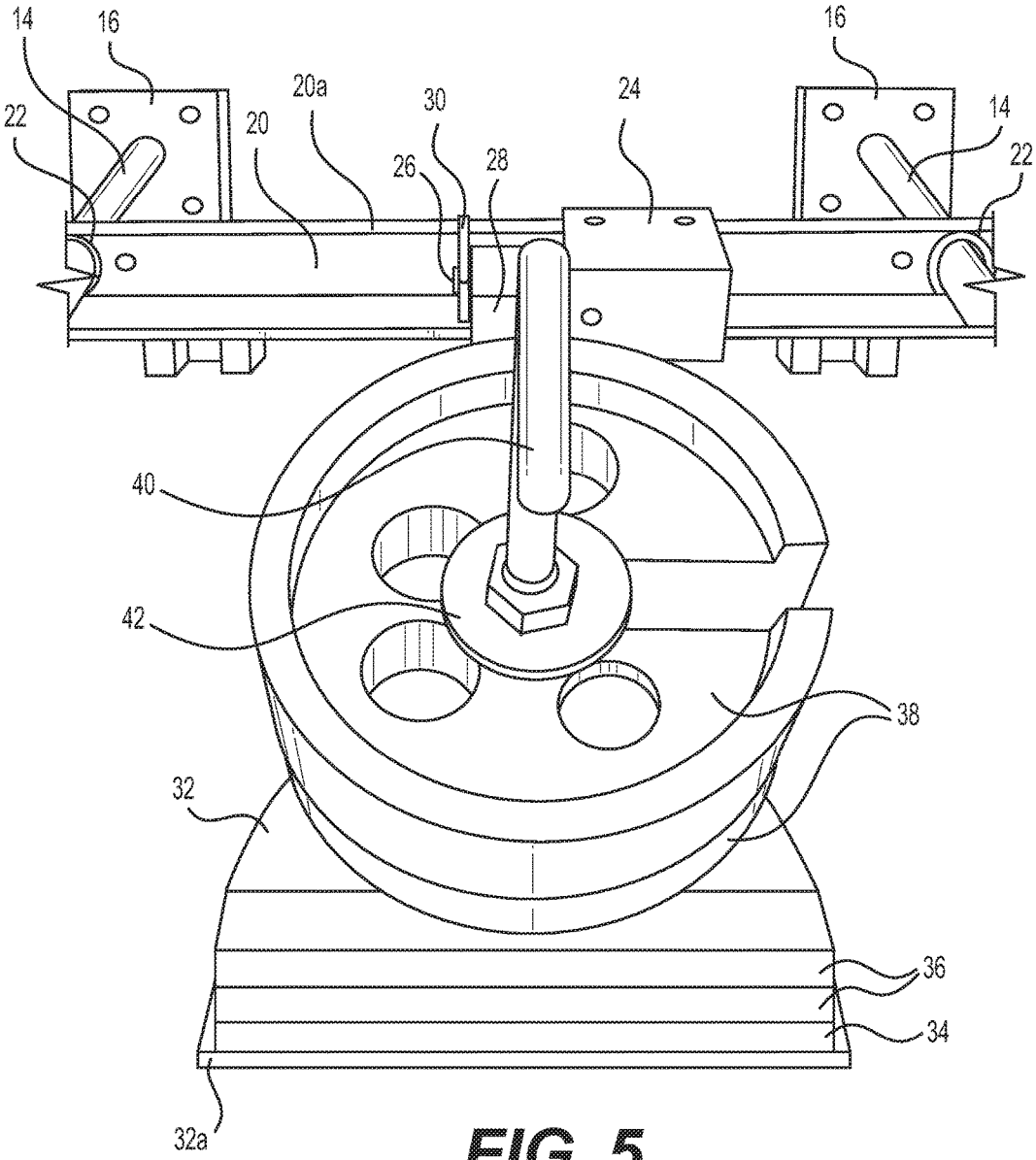
FIG. 5 is a detailed broken away end perspective view of the slidable carriage with knife of the joint embedding apparatus shown in FIG. 1.
Figure 6:
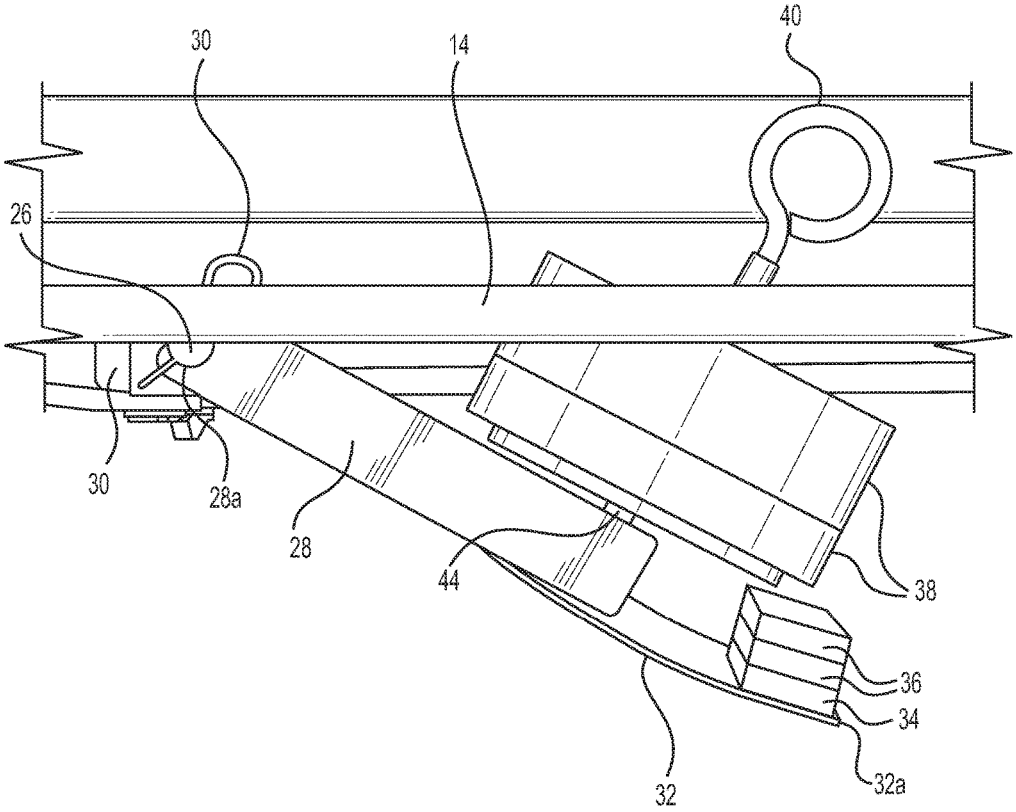
FIG. 6 is a detailed broken away side elevational view of the slidable carriage with knife of the joint embedding apparatus shown in FIG. 1.

A slidable carriage 18 supported by the pair of spaced apart rails 14 is shown in detail in FIGS. 1, 5, and 6. The slidable carriage 18 comprises a cross-member 20 (e.g. made of bar stock having angled cross-sectional profile) fitted with linear bearings 22 (FIG. 5) configured to glide along the spaced apart guide rails 14.

The carriage 18 further comprises a support block 24 (FIG. 5) having a swing arm pivot pin 26 (FIG. 6). The support block 24 is mounted on the cross-member 20 (FIG. 5). A swing arm 28 having a through hole 28*a* at an upper end thereof is fitted onto the swing arm pivot pin 26 and locked onto the end of the swing arm pivot pin 26 by a retainer 30 (e.g. clip, pin, cotter pin). The swing arm 28 is then "free" to pivot about the swing arm pivot pin 26. An upper edge 20*a* (FIG. 5) of the cross-member 20 can serve as a stop for the swing arm 28 when the swing arm is lifted upwardly and then coming into contact with the upper edge 20*a*.

A lower end of the swing arm 28 is fitted with a knife 32 having a knife edge 32*a*. The knife 32 can be fitted with one or more reinforcement bars 34 (e.g. made of metal bar stock) on an upper surface of the knife 32, as shown in FIG. 6, to prevent the knife 32 from bowing or crowing along its lower working edge. For example, the reinforcement bar 34 can be fastened, adhered, soldered, and/or welded to an upper surface of the knife 32. Further, one or more weights 36 can be added to the knife 32 (e.g. fitted on top of the reinforcement bar 34) to provide a downward force onto the tip of the knife 32.

In addition, one or more weights 38 can be fitted to the swing arm 28 (FIG. 6) to provide downward force on swing arm 28 to cause the knife 32 to bend (FIG. 6) during application of joint compound to the dry wall joint. For example, an eye bolt 40, upper washer 42, and lower washer can be used to fasten the one or more weights 38 to the swing arm 28. Specifically, a threaded end of the eye bolt 40 is threaded into a threaded hole in the top edge of the swing bar 28 (FIG. 6).

Operation

The joint tape embedding apparatus 10 can be manually operated. For example, a pair of dry wall panels are placed together and in edge contact with each other underneath the joint tape embedding apparatus 10. A joint between the adjacent dry wall panels is centered along the center longitudinal axis of joint tape embedding apparatus 10.

A quantity of joint compound is placed on the joint, and then the knife 32 is dragged along the joint by manually pulling or pushing the slidable carriage 18 to spread the joint compound along the joint. A force gauge can be applied between the slidable carriage 18 and the user's hand to determine the amount of force required to move the slidable carriage 18 in steady state.

The amount of weight applied by weights 38 can be varied run-to-run to further define an operational profile of the particular joint compound being tested and to determine or characterized the "feel" of the particular joint compound.

Enhancement

Figure 7:
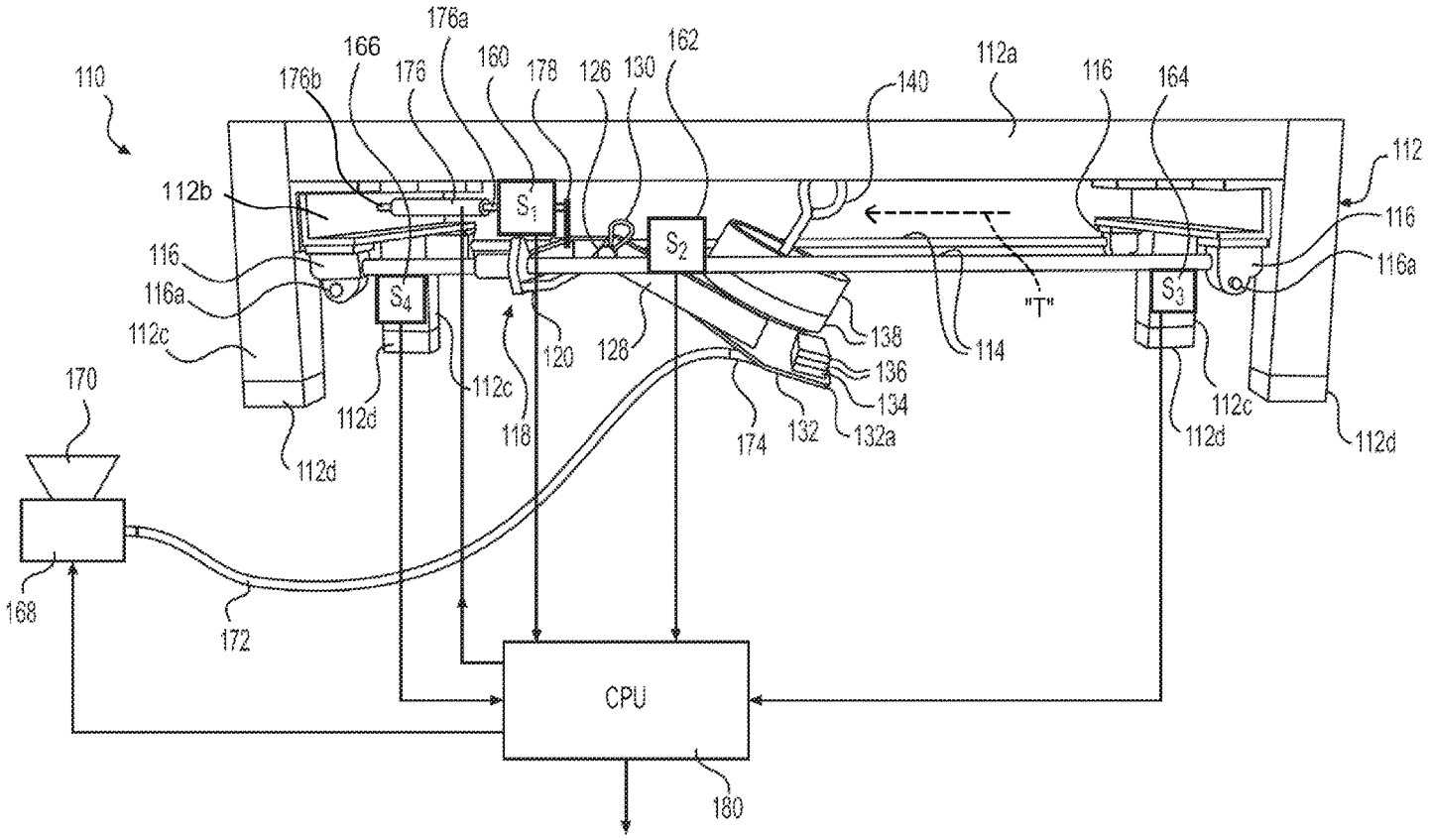
FIG. 7 is a front elevational view of another joint tape embedding apparatus according to the present invention.

Another joint tape embedding apparatus 110 according to the present invention is shown in FIG. 7.

The joint tape embedding apparatus 110 comprises a frame 112 having horizontal side members 112*a*, horizontal cross-members 112*b*, and vertical legs 112*c* connected together into the frame 112. For example, the frame 112 is made of tubing sections (e.g. rectangular steel tubing sections) welded and/or fastened together to assemble the frame 112. A set of resilient pads 112*d* are applied to the bottom ends of the vertical legs 112*c* to maintain the frame 112 stationary during use.

A pair of spaced apart guide rails 114 (e.g. made of solid or tubular round bar stock) is supported by the frame 112. Specifically, the opposite ends 114*a* of each guide rail 114 is connected to the cross-members 112*b* of the frame 112 by connectors 116 having threaded fasteners 116*a*.

A slidable carriage 118 supported by the pair of spaced apart rails 114. The slidable carriage 118 comprises a cross-member 120 (e.g. made of bar stock having an angled cross-sectional profile) fitted with linear bearings 122 configured to glide along the spaced apart guide rails 114.

The carriage 118 further comprises a support block 124 having a swing arm pivot pin 126. The support block 124 is mounted on the cross-member 120. A swing arm 128 having a through hole 128*a* at an upper end thereof is fitted onto the swing arm pivot pin 126 and locked onto the end of the swing arm pivot pin 126 by a retainer 130 (e.g. clip, pin, cotter pin). The swing arm 128 is then "free" to pivot about the swing arm pivot pin 126. An upper edge 120*a* of the cross-member 120 can serve as a stop for the swing arm 128 when the swing arm is lifted upwardly and then coming into contact with the upper edge 120*a*.

A lower end of the swing arm 128 is fitted with a knife 132 having a knife edge 132*a*. The knife 132 can be fitted with one or more reinforcement bars 134 (e.g. made of metal bar stock) on an upper surface of the knife 132, to prevent the knife 132 from bowing or crowing along its lower working edge. For example, the reinforcement bar 134 can be fastened, adhered, soldered, and/or welded to an upper surface of the knife 132. Further, one or more weights 136 can be added to the knife 132 (e.g. fitted on top of the reinforcement bar 134) to provide a downward force onto the tip of the knife 132.

In addition, one or more weights 138 can be fitted to the swing arm 128 to provide downward force on swing arm 128 to cause the knife 132 to bend during application of joint compound to the dry wall joint. For example, an eye bolt 140, upper washer 142, and lower washer can be used to fasten the one or more weights 138 to the swing arm 128. Specifically, a threaded end of the eye bolt 140 is threaded into a threaded hole in the top edge of the swing bar 128.

The joint embedding apparatus 110 can further comprise sensors 160, 162, 164, 166 ($S_1$, $S_2$, $S_3$, $S_4$) for detecting the operation of the joint embedding apparatus 110. For example, a location/speed sensor $S_1$ is connected to slidable carriage 118, a force sensor $S_2$ is connected to swing arm 128 to detect the amount of force exerted on the swing arm during operation, a start sensor $S_3$ is connected to the initiating end 14*a* of the guide rails 14, and a finish sensor $S_4$ is connected to the finish end 14*a* of the guide rails 14. The sensors $S_1$, $S_2$, $S_3$, $S_4$ are electrically connected to a central processing unit (CPU) 180 (e.g. of a computer) for inputting signal thereto.

The joint embedding apparatus 110 can even further comprise a joint compound pump 168 having a funnel for receiving bulk joint compound. A length of tubing 172 connects the joint compound pump 168 to a delivery nozzle 174 configured to direct joint compound at a position below the knife 132 during operation. Further, an actuator 176 (e.g.

electronic, hydraulic, pneumatic) can be provided between the carriage 118 and the horizontal cross-member 112*b* for moving the slidable carriage 118 along the guide rails 114 along a direction of slidable travel "T" as seen in FIG. 7. Specifically, an extension rod 176*a* of the actuator 176 is connected to a bracket 178 connected to the cross-member 120 of the slidable carriage 118, and a rod connector 176*b* is connected to the cross-member 112*b*. The joint compound pump 168 and actuator 176 are electrically connected to the central processing unit (CPU) 160 and controlled thereby.

Operation

The joint embedding apparatus 110 can be programmed to operate and control the joint embedding apparatus 110 in a particular manner to being test and determine or characterized the "feel" of the particular joint compound.

The invention claimed is:

1. A joint tape embedding apparatus configured for controlled embedding of the joint tape into joint compound, the apparatus comprising:

a frame;

a pair of spaced apart rails supported by the frame;

a carriage slidably supported by said rails;

a swing arm pivotably connected to the carriage; and a knife connected to the swing arm; and wherein the knife is provided with one or more weights and/or the pivoting arm is provided with one or more weights.

2. The apparatus according to claim 1, wherein the knife is provided with one or more weights.

3. The apparatus according to claim 2, wherein the one or more weights on the knife can be changed.

4. The apparatus according to claim 2, wherein the pivoting arm is provided with one or more weights.

5. The apparatus according to claim 4, wherein the knife is provided with a reinforcement bar configured to reinforce an edge of the knife.

6. The apparatus according to claim 4, wherein an upper end of the pivoting arm is pivotably connected to the slidable carriage and a lower end of the pivoting arm is fixed to the knife.

7. The apparatus according to claim 1, wherein the pivoting arm is provided with one or more weights.

8. The apparatus according to claim 7, wherein the one or more weights on the pivoting arm can be changed.

9. The apparatus according to claim 1, wherein the knife is provided with a reinforcement bar configured to reinforce an edge of the knife.

10. The apparatus according to claim 1, further comprising a joint compound applicator for delivering joint compound to the knife during operation.

11. The apparatus according to claim 10, wherein the joint applicator comprises a joint compound pump having tubing connected to a nozzle located to supply joint compound to the knife.

12. The apparatus according to claim 1, wherein the spaced apart rails are connected to cross-members of the frame located at ends of the frame.

13. The apparatus according to claim 1, further comprising an actuator configured to move the slidable carriage.

14. The apparatus according to claim 13, comprising a sensor configured to measure force on the knife during operation.

15. The apparatus according to claim 13, further comprising one or more sensors for detecting the location and speed of movement of the slidable carriage during operation.

16. A joint tape embedding system configured for controlled embedding of joint tape into a drywall joint using a particular joint compound, the apparatus comprising:

the apparatus according to claim 1, comprising the frame;

the pair of spaced apart rails supported by the frame;

the carriage slidably supported by said rails;

the swing arm pivotably connected to the carriage;

the knife connected to the swing arm, wherein the knife is provided with one or more weights and/or the pivoting arm is provided with one or more weights;

one or more electrical sensors to measure one or more of force, drag and knife deflection involved with the spreading or applying the joint compound into a joint using the knife; and a computer for receiving input signals from the one or more electrical sensors and configured to provide quantitative assessment of the feel attributes of the joint compound.

17. A method for controlled embedding of joint tape into a drywall joint using a particular joint compound comprising:

providing a measuring device comprising the apparatus of claim 1 comprising the frame;

the pair of spaced apart rails supported by the frame;

the carriage slidably supported by said rails;

the swing arm pivotably connected to the carriage; and a knife applicator comprising the knife, wherein the knife is connected to the swing arm, wherein the knife is provided with one or more weights and/or the pivoting arm is provided with one or more weights;

providing a supply of joint compound to be measured to the knife applicator;

using the knife applicator to apply joint compound to embed joint tape into a drywall joint;

measuring one or more force, drag and knife deflection involved with the spreading or applying of the joint compound using the knife applicator;

quantitatively assessing the particular joint compound using the measured one or more force, drag and knife deflection of the knife; and determining the feel of the particular joint compound expressed in a manner understandable to user's of joint compounds.

18. A joint tape embedding apparatus configured for controlled embedding of the joint tape into joint compound, the apparatus comprising:

a frame;

a pair of spaced apart rails supported by the frame;

a carriage slidably supported by said rails;

a swing arm pivotably connected to the carriage; and a knife connected to the swing arm; and a joint compound applicator for delivering joint compound to the knife during operation.

19. A joint tape embedding apparatus configured for controlled embedding of the joint tape into joint compound, the apparatus comprising:

a frame;

a pair of spaced apart rails supported by the frame;

a carriage slidably supported by said rails to slide in a sliding direction;

a swing arm pivotably connected to the carriage; and a knife, for embedding the joint tape into the joint compound, connected to the swing arm, wherein the knife has an exposed edge, distal to the swing arm, transverse to the sliding direction.

20. The apparatus according to claim 19, wherein the swing arm is pivotably connected between the rails to the carriage.

* * * * *